US005743496A

United States Patent [19]

Atkinson, Jr.

[11] Patent Number: 5,743,496

[45] Date of Patent: Apr. 28, 1998

[54] RAILROAD FROG CROSSING BOLT AND NUT ASSEMBLY FOR CLAMPING RAILROAD RAIL SECTIONS TOGETHER

[75] Inventor: Samuel G. Atkinson, Jr., Omaha, Nebr.

[73] Assignee: Upcor, Inc., Davenport, Iowa

[21] Appl. No.: 801,014

[22] Filed: Feb. 19, 1997

[51] Int. Cl.[6] ..... E01B 7/10

[52] U.S. Cl. ..... 246/463; 246/472

[58] Field of Search ..... 246/454, 382, 246/463, 468, 472; 411/366, 368, 378, 537, 538

[56] References Cited

U.S. PATENT DOCUMENTS

| | | | |
|---|---|---|---|
| 1,352,918 | 9/1920 | Rohbock | 411/537 |
| 1,668,169 | 5/1928 | Palmer | 246/463 |
| 2,120,462 | 6/1938 | Ferguson | 246/463 |
| 4,360,154 | 11/1982 | Collins | 238/262 |
| 4,416,573 | 11/1983 | Matalis et al. | 411/378 |
| 4,735,537 | 4/1988 | Rath | 411/411 |
| 4,822,227 | 4/1989 | Duran | 411/373 |
| 4,906,153 | 3/1990 | Duran | 411/353 |
| 5,074,730 | 12/1991 | Duran | 411/403 |
| 5,263,802 | 11/1993 | Fichot et al. | 411/26 |
| 5,366,184 | 11/1994 | Testart et al. | 246/385 |
| 5,393,019 | 2/1995 | Oritz-Rivas | 246/463 |
| 5,405,228 | 4/1995 | Reid et al. | 411/183 |
| 5,413,442 | 5/1995 | Grey | 411/366 |
| 5,522,570 | 6/1996 | Benenowski et al. | 246/463 |

FOREIGN PATENT DOCUMENTS

| | | | |
|---|---|---|---|
| 1193489 | 11/1959 | France | 411/537 |
| 532663 | 1/1941 | United Kingdom | 411/538 |

*Primary Examiner*—S. Joseph Morano

*Attorney, Agent, or Firm*—Zarley,McKee,Thomte Voorhees & Sease; Dennis L. Thomte

[57] ABSTRACT

A railroad frog crossing bolt and nut is provided for clamping railroad rail sections together. The bolt is provided with a head which has a radiused portion which is adapted to be received in a countersink area in either a beveled washer or a D-bar. The inner end of the nut is also radiused which is adapted to be received in a countersink area formed in a beveled washer or D-bar.

5 Claims, 4 Drawing Sheets

RAILROAD FROG CROSSING BOLT AND NUT ASSEMBLY FOR CLAMPING RAILROAD RAIL SECTIONS TOGETHER

BACKGROUND OF THE INVENTION

1. Field of the Invention

This invention relates to a railroad frog crossing bolt and nut assembly for clamping railroad sections together and more particularly to an assembly which permits alignment adjustment.

2. Description of the Related Art

Turnout and crossing frogs have long been used in the railroad industry to enable a pair of railroad rail sections to cross another pair of railroad rail sections or to permit a pair of railroad rail sections to turn out with respect to the direction of the rail sections. Generally speaking, the turnout and crossing frogs utilize bolt and nut assemblies which extend between and which connect spaced-apart rail sections. However, the parts being joined generally do not run in parallel planes, which makes the connection thereof difficult. In the past, many of the problems associated with turnout and crossing frogs can be traced to broken and loose bolts. Due to the fact that the parts or rail sections being secured together do not run in parallel planes, the bolts failed or became loose, since it was impossible to position the bolt at a right angle to each of the members being connected together. A partial solution to past problems has been to use beveled washers or wedges beneath the head of the bolt and under the nut. The practical result of this practice has been an improvement in the situation, but seldom do the wedges provide exact compensation for the misalignment problem. Without exact parallel planes, one side of the bolt head and nut absorbs all the pressure applied through torque which overstresses one side of the bolt which, when combined with the static and dynamic loads imparted by rolling stock, results in overload and failure of the bolt.

SUMMARY OF THE INVENTION

A railroad frog crossing bolt and nut assembly is provided for clamping railroad rail sections together with each of the rail sections having a base portion and a top head portion separated by an integrally formed web portion having at least one bolt opening extending therethrough which registers with the bolt opening in the web portion of the other rail section. Each of the web portions have oppositely disposed inner and outer side wall portions. The bolt and nut assembly of this invention comprises a bolt having a head from which extends an elongated shank including an unthreaded shank portion extending from the head which terminates at a threaded shank portion. The juncture of the unthreaded shank portion and the bolt head is radiused to provide a first annular radius surface. A nut is adapted to be threadably mounted on the threaded shank portion and has inner and outer surfaces with the inner surface of the nut being radiused to provide a second annular radiused surface. A first bar member or beveled washer is positioned adjacent the outer side wall of the web of one of the rail sections and which has a bolt opening formed therein. The outer surface of the first bar member or beveled washer has a recessed radius surface formed therein extending around the bolt opening which is adapted to receive one of the first and second radiused surfaces. A second bar member or beveled washer is positioned adjacent the outer side wall portion of the web of the other rail section and has a bolt opening formed therein. The outer surface of the second bar member or beveled washer has a recessed radius surface formed therein extending around the bolt opening adapted to receive the other of the said first and second radiused surfaces.

It is therefore a principal object of the invention to provide an improved railroad frog crossing bolt and nut assembly.

Yet another object of the invention is to provide an improved frog crossing bolt and nut assembly for clamping railroad rail sections together.

Still another object of the invention is to provide a railroad frog crossing bolt and nut assembly which utilizes the prior art wedge concept and a final adjustment feature with the wedges compensating for gross misalignments with the final adjustment feature being provided by a radiused bolt head and nut which naturally seeks exact perpendicular alignment and thus full contact by rotating in the mate radiuses in the hardened profile specific wedges.

Still another object of the invention is to provide for a bolting system utilized in crossing frogs and turnouts which allows for alignment adjustment.

These and other objects will be apparent to those skilled in the art.

DESCRIPTION OF THE PREFERRED EMBODIMENT

Figure 1:
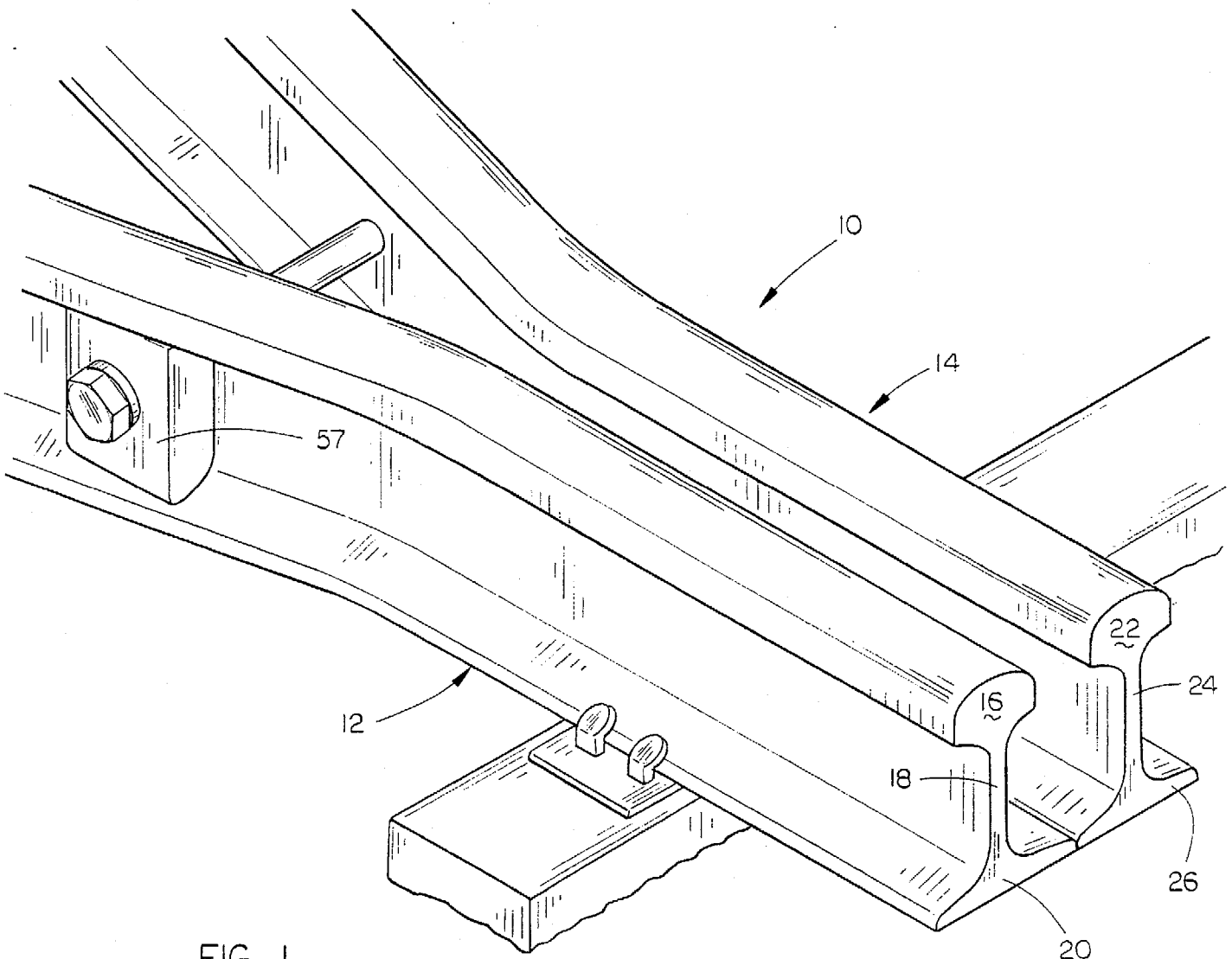
FIG. 1 is a perspective view of the bolt and nut assembly of this invention extending between a pair of railroad rail sections.

In the drawings, the numeral 10 refers generally to a frog crossing or turnout of conventional design and including a first rail section 12 and a second rail section 14 which are positioned side by side, as best viewed in FIG. 1. Rail section 12 includes a head portion 16, web portion 18 and base portion 20. Similarly, rail section 14 includes a head portion 22, web portion 24 and base portion 26.

Figure 2:
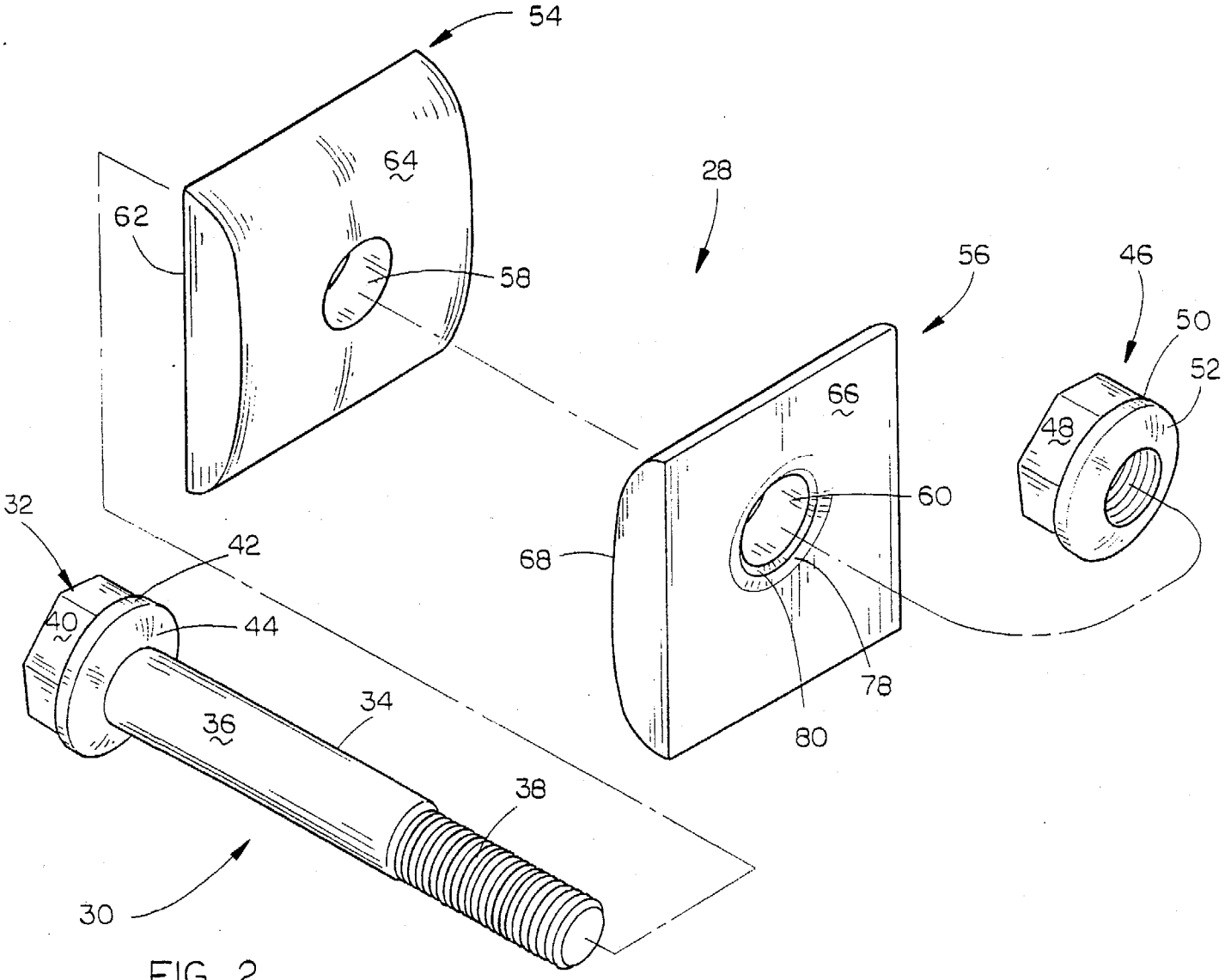
FIG. 2 is an exploded perspective view of the bolt and nut assembly of this invention.

With respect to FIG. 2, the numeral 28 refers generally to the nut and bolt assembly of this invention. Assembly 28 includes a bolt 30 including a head 32 having an elongated shank 34 extending therefrom which includes an unthreaded portion 36 and a threaded portion 38. Head 32 includes a hexagonal portion 40 and an annular portion 42 having a radiused inner portion 44. The numeral 46 refers to a nut having an internally threaded bore adapted to be threadably received by the threaded portion 38 of bolt 30. Nut 46 includes a hexagonal outer end portion 48 and an annular portion 50 having an inner radiused surface 52.

Referring to FIG. 2, the numerals 54 and 56 refer to D-bars having openings 58 and 60 extending therethrough, respectively. For purposes of description, D-bar 54 will be described as including an outer surface 62 and an arcuate inner surface 64 which is adapted to conform to the outer surface of the rail section 12. Likewise, for purposes of description, D-bar 56 will be described as having an outer surface 66 and an arcuate inner surface 68 which is adapted to conform to the exterior surface of rail section 14. When D-bars are utilized, the openings 58 and 60 of D-bars 54 and 56 are adapted to be aligned with the openings 70 and 72 formed in webs 18 and 24 of rail sections 12 and 14, respectively. When beveled washers 57 are utilized, the openings therein are aligned with openings 70 and 72.

Figure 3:
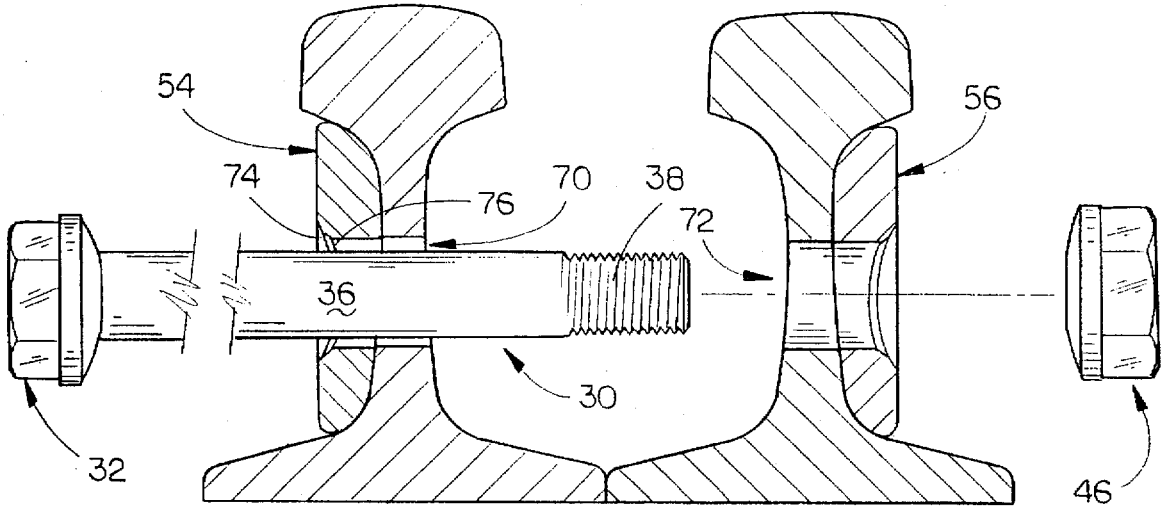
FIG. 3 is a sectional view of a pair of railroad rail sections having the bolt and nut assembly extending therethrough.
Figure 4:
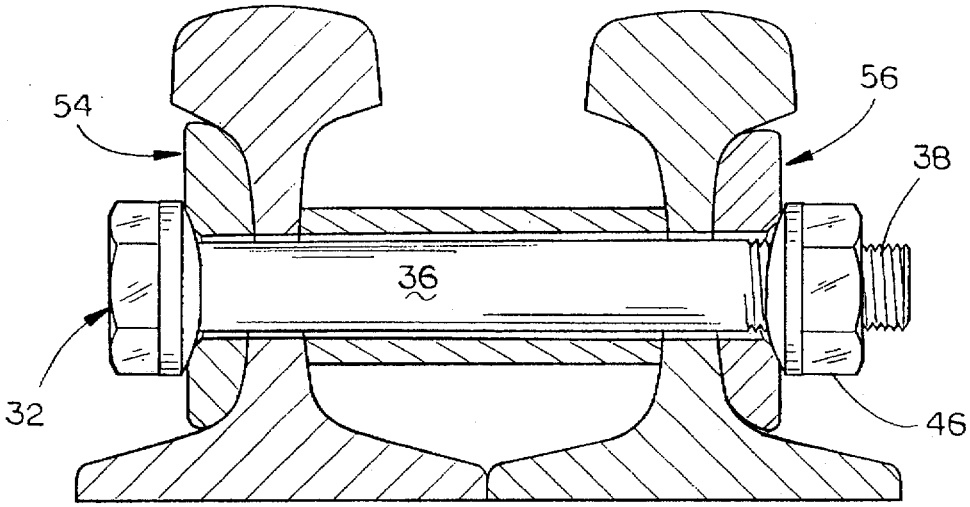
FIG. 4 is a view similar to FIG. 3 except that the bolt and nut assembly of this invention has been installed between the railroad rail sections.
Figure 5:
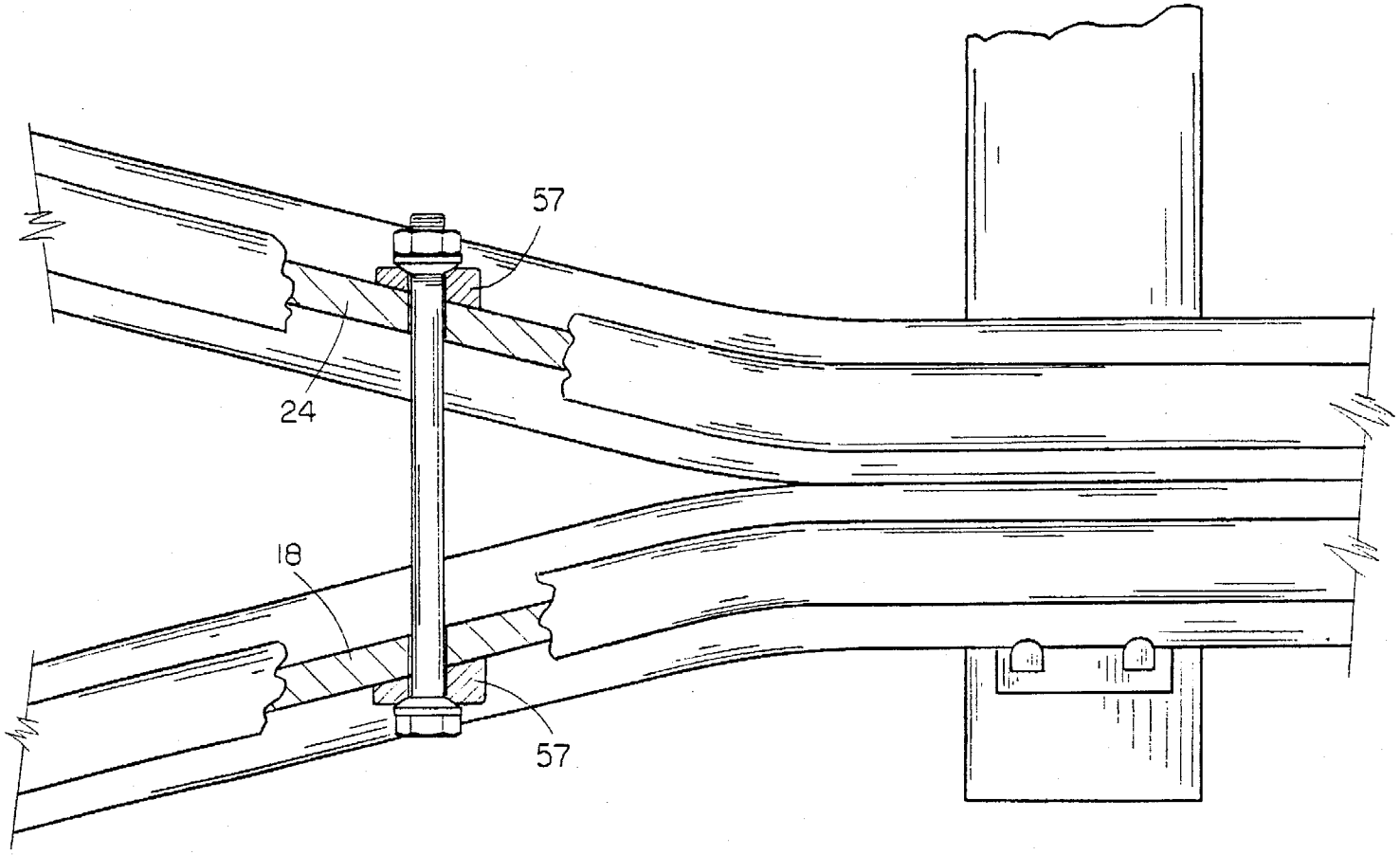
FIG. 5 is a partial top view of a pair of rail sections having the bolt and nut assembly of this invention extended therebetween.

Depending upon where the bolts 30 extend between the rails, D-bars 54 and 56 may be used or beveled washers 57 may be used. If the bolts 30 extend between parallel rails, the D-bars such as seen in FIG. 2 may be utilized. If the bolt 30 extends between angled rails as shown in FIG. 1, beveled washers 57 will be utilized so that the outer surfaces of the beveled washers will be substantially perpendicular with respect to the longitudinal axis of the associated bolt. FIGS. 3 and 4 illustrate the rails 12 and 14 being in a parallel relationship with D-bars 54 and 56 being utilized. FIGS. 1 and 5 illustrate the rails 12 and 14 in a non-parallel relationship and wherein the beveled washers 57 are utilized.

D-bar 54 is provided with a radius countersink area 74 formed therein, the inner end of which is further beveled at 76. Similarly, the outer end of D-bar 56 is provided with a radius countersink area 78 formed therein which is further beveled at 80. Preferably, the countersink and beveled areas in the outer surfaces of D-bars 54 and 56 are micro-finished. As best seen in FIG. 3, the diameters of openings 58, 70, 72 and 60 are greater than the unthreaded portion 36 of bolt 30 to permit the bolt 30 to be angularly disposed with respect to those openings. If beveled washers 57 are employed, the washers are provided with identical countersink areas and bevels.

As stated hereinabove, the frog bolting system of this invention is an effort to improve the surface life of special track work. As stated, heretofore, there has been a definite need for a bolting system that allows for alignment adjustment inasmuch as the parts being joined do not always run in parallel planes. As stated, the answer in the past has been to correct the situation by using beveled washers or wedges under the head of the bolt and under the nut. Without exact parallel planes, one side of the bolt head and the nut absorb all the pressure applied through torque which overstresses one side of the bolt, and when combined with the static and dynamic loads imparted by rolling stock, results in overload and failure of the bolt.

When the parts being joined do run in generally parallel planes, the D-bars 52 and 54 may be utilized with the radiused portions 44 and 52 of the bolt 30 and nut 44, respectively, cooperating with the radiused countersink areas 74 and 78, respectively, so that one side of the bolt head and the nut will not absorb all the pressure applied through torque. When the parts being joined do not run in parallel planes, the beveled washers are utilized with the radiused portions and countersink areas described hereinabove adding the final advantage of a final adjustment feature. The beveled washers compensate for gross misalignments while the radiused bolt head and nut naturally seek perpendicular alignment and thus full contact by rotating in the mate radiuses in the hardened profile specific D-bars or wedges.

Thus it can be seen that the invention accomplishes at least all of its stated objectives.

I claim:

1. A railroad frog crossing bolt and nut assembly for clamping railroad rail sections together, each of said rail sections having a base portion and a top head portion separated by an integrally formed web portion having at least one bolt opening extending therethrough which registers with the bolt opening in the web portion of the other rail section, each of said web portions having oppositely disposed inner and outer side wall portions, comprising:

a bolt having a head from which extends an elongated shank having an unthreaded shank portion extending from said head and terminating at a threaded shank portion;

the juncture of said unthreaded shank portion and said head being radiused to provide a first annular radiused surface;

a nut adapted to be threadably mounted on said threaded shank portion and having inner and outer surfaces;

said inner surface of said nut being radiused to provide a second annular radiused surface;

a first member positioned adjacent said outer side wall portion of said web of one of said rail sections and having inner and outer surfaces;

said first member having a bolt opening formed therein which extends therethrough between said inner and outer surfaces thereof;

said outer surface of said first member having a recessed countersink area formed therein extending around said bolt opening adapted to receive one of said first and second radiused surfaces;

a second member positioned adjacent said outer side wall portion of said web of the other of said rail sections and having inner and outer surfaces;

said second member having a bolt opening formed therein which extends therethrough between said inner and outer surfaces thereof;

said outer surface of said second member having a recessed countersink area formed therein extending around said bolt opening adapted to receive the other of said first and second radiused surfaces.

2. The assembly of claim 1 wherein said first and second members each comprises a D-bar.

3. The assembly of claim 1 wherein said first and second members each comprise a beveled washer.

4. The assembly of claim 2 wherein said countersink area has inner and outer ends and wherein the inner end of said countersink area is beveled.

5. The assembly of claim 3 wherein said countersink area has inner and outer ends and wherein the inner end of said countersink area is beveled.

* * * * *

UNITED STATES PATENT AND TRADEMARK OFFICE
Certificate

Patent No. 5,743,496 Patented: April 28, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Samuel G. Atkinson, Jr., Omaha, Nebraska; and Dale A. Kirkpatrick, Omaha, Nebraska.

Signed and Sealed this Twenty-eighth Day of December 2004.

S. JOSEPH MORANO
*Supervisory Patent Examiner*
Art Unit 3617